US006272861B1

(12) United States Patent
Bergmann

(10) Patent No.: US 6,272,861 B1
(45) Date of Patent: Aug. 14, 2001

(54) THERMAL POWER PLANT HAVING A STEAM TURBINE AND METHOD FOR COOLING A STEAM TURBINE IN A VENTILATION MODE

(75) Inventor: Dietmar Bergmann, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/282,095

(22) Filed: Mar. 30, 1999

Related U.S. Application Data

(63) Continuation of application No. PCT/DE97/02105, filed on Sep. 18, 1997.

(30) Foreign Application Priority Data

Sep. 30, 1996 (DE) ..... 196 40 298

(51) Int. Cl.[7] ..... F01B 31/00

(52) U.S. Cl. ..... 60/657; 60/670; 415/115; 415/116

(58) Field of Search ..... 60/657, 660, 662, 60/670; 415/115, 116

(56) References Cited

U.S. PATENT DOCUMENTS

| | | | | |
|---|---|---|---|---|
| 3,306,576 | * | 2/1967 | Chaboseau . | |
| 4,079,587 | * | 3/1978 | Nordstrom et al. | 415/115 |
| 5,320,483 | * | 6/1994 | Cunha et al. | 415/114 |
| 5,490,386 | * | 2/1996 | Keller et al. | 60/660 |
| 5,577,884 | * | 11/1996 | Mari | 415/115 |
| 5,829,245 | * | 11/1998 | McQuiggan et al. | 415/114 X |
| 5,980,202 | * | 11/1999 | Tomita et al. | 415/115 |
| 6,019,572 | * | 2/2000 | Cunha | 415/115 X |

* cited by examiner

*Primary Examiner*—Hoang Nguyen
(74) *Attorney, Agent, or Firm*—Herbert L. Lerner; Laurence A. Greenberg; Werner H. Stemer

(57) ABSTRACT

A thermal power plant includes a steam turbine having guide blades. At least one of the guide blades has a cavity. The cavity is connected to a fluid conduit for feeding fluid and to orifice conduits opening on an outer surface of the guide blade. A method for cooling a steam turbine in a ventilation mode is also provided.

18 Claims, 3 Drawing Sheets

THERMAL POWER PLANT HAVING A STEAM TURBINE AND METHOD FOR COOLING A STEAM TURBINE IN A VENTILATION MODE

CROSS-REFERENCE TO RELATED APPLICATION

This application is a continuation of copending International Application No. PCT/DE97/02105, filed Sep. 18, 1997, which designated the United States.

BACKGROUND OF THE INVENTION

Field of the Invention

The invention relates to a thermal power plant, including a steam turbine having a turbine rotor directed along a main axis and surrounded by an inner housing. A guide-blade structure, which surrounds the turbine rotor in the circumferential direction and has guide blades, is disposed in the inner housing. The invention also relates to a method for cooling a steam turbine in the ventilation mode, in particular a low-pressure steam turbine.

It is known, for example from a book entitled "Str ömungs-maschinen" [Turbo-Machines] by K. Menny, Teubner-Verlag, Stuttgart, 1985, Section 3.4.6"Naβdampfstufen" [Wet-Steam Stages], that condensation of action steam takes place in steam turbines, in particular in so-called wet-steam stages. During an expansion of the steam in the steam turbine, supercooled steam occurs if there is a fall below a boundary curve with the wet-steam region, for example in the case of condensing turbines. The temperature of the supercooled steam is lower than a saturation temperature associated with the steam point. At specific supercooling, spontaneous condensation commences, in which small mist droplets occur that may settle on guide blades in the form of a water film or individual strands of water. The water film breaks away from trailing edges of the guide blades and forms secondary drops having a diameter of up to about 400 $\mu$m. Those steam droplets which break away may lead to a stripping of material, if they impinge on the moving blades, particularly when the drops have a diameter on the order of magnitude of 50 to 400 $\mu$m (so-called drop impact erosion). In order to avoid such drop impact erosion, the water film is often sucked away directly on the guide-blade surface. For that purpose, a hollow guide blade has slots which connect its interior to the condenser of the steam turbine.

German Published, Non-Prosecuted Patent Application DE-OS 19 51 922 specifies a device for preventing the formation of droplets in the low-pressure stages of steam turbines. Droplets are prevented from forming by feeding hot steam to the guide blades of the last guide-blade rows through an outer ring. The hot steam is conducted through the hollow guide blades to an inner ring and is conducted out of it again through a geodetically low-lying outflow conduit. The guide blades are to be heated to such an extent by feeding hot steam that condensation cannot take place at all.

Austrian Patent 250 402 describes introducing steam from preceding stages into guide-blades and feeding it into the steam flow again through slots in the guide blades. The avoidance of the formation of condensate on guide blades is likewise dealt with in U.S. Pat. No. 3,306,576, wherein hot steam is fed to a hollow guide blade and passing out of it through bores into the steam flow. The hot steam heats the steam flow to such an extent that the saturation temperature is exceeded at least locally and no condensation takes place.

A steam turbine blade which has a hollow structure and has an orifice for diverting steam into a main steam flow, is likewise described in the abstract of Japanese Patent Application 54-14 1908, Patent Abstracts of Japan, Jan. 18, 1980, Vol. No. 4.

European Patent 0 602 040 B1, corresponding to German Published, Non-Prosecuted Patent Application DE 41 29 518 A1and corresponding U.S. Pat. No. 5,490,386, describes a method for cooling a low-pressure steam turbine in the ventilation mode, wherein the rotor of the steam turbine is rotated, without being subjected to steam to be expanded. In a low-pressure turbine working in the ventilation mode, a steam atmosphere prevails, having a static pressure which corresponds to the pressure prevailing in the condenser connected to the low-pressure turbine. The friction of the turbine blades on the steam (ventilation) may lead to a considerable amount of heat being generated, with the result that the turbine may be heated to a high, possibly even inadmissibly high temperature. In order to avoid that from occurring, cooling measures are employed, in which, for example, condensate is injected, while at the same time being atomized, into the outlet or, if the cooling capacity to be applied has to be particularly high, into the inlet of the turbine. The condensate evaporates, with its temperature thereby being lowered, and as a result, the ventilating turbine is cooled. If injection takes place at the outlet, the cooling effect is often restricted to parts of the turbine in the vicinity of the outlet. If injection takes place at the inlet, condensate which agglomerates in the region of the inlet may put the blading of the turbine at risk due to surging. Therefore, according to European Patent 0 602 040 B1, corresponding to German Published, Non-Prosecuted Patent Application DE 41 29 518 A1 and corresponding U.S. Pat. No. 5,490,386, steam is fed into the steam turbine through a tapping point located between the outlet and the inlet of the steam turbine. Cooling in the turbine thereby first benefits the radially outer ends of the blades. The ends are subjected to the highest load as a result of the friction on the steam located in the turbine. The cooling effect is thus restricted essentially to those regions of the turbine in which it is desired. The cooling of other components of the turbine, for example, of the turbine shaft, is avoided.

Besides steam, condensate is additionally fed to a tapping conduit connected to the tapping point, in particular by injecting condensate into the steam transfer conduit and/or into the tapping conduit through the use of a condensate transfer conduit. The condensate is preferably mixed with the steam in an atomizer nozzle and is injected from that atomizer nozzle into the tapping conduit. A particularly high cooling effect is achieved by a condensate which is distributed into fine droplets and the droplet diameters of which are smaller than about 0.1 mm. The cooling process is controlled through a temperature measuring point located between the tapping point and the outlet, the feed of the steam or the feed of the steam/condensate mixture for tapping being regulated as a function of the measured temperature. The quantity of steam or steam/condensate mixture fed to the tapping conduit is approximately on the order of magnitude of 1% of the steam stream when the steam turbine is operating in the power mode. The steam used for cooling comes from a condensate container which serves for collecting, heating and degassing the condensate. Steam from the condensate container, to which hot steam is usually fed for the purpose of degassing the condensate, is saturated due to the coexistence of steam. Condensate, if appropriate, is even mixed with finely distributed condensate, and is therefore particularly suitable for injection into the ventilating turbine. Furthermore, steam may be extracted from a steam discharge conduit, through the use of which the steam is conducted past the low-pressure turbine in the ventilation mode. Such a steam discharge conduit conducts the steam, for example, from a high-pressure steam turbine preceding the low-pressure steam turbine or from a configuration formed of a high-pressure steam turbine and of a medium-pressure steam turbine, around the low-pressure steam turbine, to a heating device or the like, where the steam is possibly cooled and condensed. In order to obtain a steam/condensate mixture, the steam to be fed to the tapping point may be extracted from such a heating device. The steam may likewise be extracted from a high-pressure or medium-pressure steam turbine preceding the low-pressure steam turbine, directly or indirectly, for example from a preheater or the like fed by the turbine. Such steam normally has a sufficiently high characteristic pressure, so that feeding into the ventilating steam turbine can take place without separate pumps or the like.

SUMMARY OF THE INVENTION

It is accordingly an object of the invention to provide a thermal power plant having a steam turbine and a method for cooling a steam turbine in a ventilation mode, which overcome the hereinafore-mentioned disadvantages of the heretofore-known devices and methods of this general type, in which the steam turbine can be cooled simply and effectively in a ventilation mode and/or in which condensation on guide-blades can be avoided, or at least reduced, simply and effectively.

With the foregoing and other objects in view there is provided, in accordance with the invention, a thermal power plant, comprising a steam turbine including a turbine rotor directed along a main axis, an inner housing surrounding the turbine rotor, a guide-blade structure disposed in the inner housing and surrounding the turbine rotor in circumferential direction, the guide-blade structure having guide blades, and at least one of the guide blades having a cavity formed therein, having an outer surface and having at least one orifice conduit branching off from the cavity and opening to the outer surface; a fluid conduit connected to the cavity for feeding cooling fluid; a condensate vessel; and a closeable transfer conduit connected between the condensate vessel and the fluid conduit.

In an idling and/or low-power mode (ventilation mode), the blades of the last blade rows of a low-pressure steam turbine, in particular, become heated. In such a ventilation mode, a meander flow having an insignificant effective backflow is formed. Feeding finely atomized water or wet steam, generally cooling fluid, through the orifice conduit into the steam turbine gives rise, upstream of the outlet, to a cooling of the-guide blades and moving blades. Evaporation of water droplets thus brings about effective cooling, particularly of the last low-pressure blade rows which are heated to the greatest extent in the ventilation mode. In this case, through the use of a change-over of the feed of fluid into the fluid conduit, the steam turbine can, on one hand, be heated locally by applying a hot fluid in a regular power mode, in order to avoid the action steam condensing on the guide blades connected to the fluid conduit, and, on the other hand, be cooled by applying a cooling fluid, for example water or wet steam, in a ventilation mode. The orifice conduit is preferably constructed, on the outer surface, as a hole, in particular with an approximately circular or elliptic crosss-ection.

A fluid, preferably superheated steam, may be fed into the action steam stream through the cavity and through the orifice conduit which, in particular, is a bore. Feeding steam through a multiplicity of fine orifice conduits and heating the guide blades as a result thereof produces a steam cushion which prevents the agglomeration of large drops on the blade surface. Admixing hot steam in the vicinity of the outer surface of the guide blade in particular reduces the wet-steam fraction which would otherwise be very high, for example on the last low-pressure guide-blade row of a low-pressure steam turbine. The risk of drop impact erosion is at least markedly reduced thereby. The hollow guide blade is preferably disposed in one of the last guide-blade rows, in particular the antepenultimate, the penultimate or the last guide-blade row.

In accordance with another feature of the invention, the guide blades of the steam turbine are connected to an outer-ring chamber for conducting the fluid that is required in each case, with the fluid conduit opening into the outer-ring chamber. As a result, all of the guide blades of a guide-blade row can be fed with the fluid in a simple way.

In accordance with a further feature of the invention, in order to provide the discharge of condensation water, the outer-ring chamber has a drainage conduit in its low region.

In accordance with an added feature of the invention, the fluid conduit is connected to the outer-ring chamber in a geodetically high region.

In accordance with an additional feature of the invention, in guide blades are connected to an inner-ring chamber in order to simplify the construction, to increase thermal mechanical stability and to conduct the cooling fluid or heating fluid. Thus, particularly in the case of guide blades having cavities which extend from the outer-ring chamber to the inner-ring chamber, it is also possible to feed the fluid into the individual guide-blades both from the inner-ring chamber and from the outer-ring chamber.

In accordance with yet another feature of the invention, the steam turbine can be connected, during operation in a power mode, to a plant component carrying hot steam, for example a high-pressure steam turbine, and/or, in a ventilation mode, to a plant component carrying water, in particular condensate, or wet steam, for example a condenser, a preheater, a heat exchanger, etc. Corresponding connecting conduits between the fluid conduit and the corresponding plant components can be cut in and cut out through corresponding actuators or shut-off valves. It is also possible to provide a central actuator which is connected to various feed conduits for hot fluid and cooling fluid and which is connected to the fluid conduit. Depending on the particular requirement, a fluid having a desired pressure and temperature state can be fed to the fluid conduit from a feed conduit or a plurality of feed conduits through this actuator.

In accordance with yet a further feature of the invention, the orifice conduit opens on the outer surface of the guide blade, preferably on the suction side in the region of the onflow edge. As a result, in the ventilation mode, cooling fluid spreads from the onflow edge over the entire surface of the suction side of the guide blade towards the flow-off edge, as a cooling film as it were. In the power mode, the hot fluid is likewise mixed with the action steam in a region around the surface of the guide blade, thereby effectively avoiding, or at least markedly reducing, the formation of relatively large condensate droplets.

With the objects of the invention in view there is also provided a method for cooling a steam turbine in a ventilation mode, which comprises providing a turbine rotor directed along a main axis; providing an inner housing surrounding the turbine rotor; providing a guide-blade structure in the inner housing surrounding the turbine rotor in circumferential direction; providing a hollow guide blade of the guide-blade structure; and feeding a fluid, in particular wet steam or condensate, through at least the hollow guide blade into the inner housing, in a ventilation mode.

This leads to effective cooling of the blades, particularly in the case of the last blade rows of a low-pressure steam turbine. With regard to carrying out the method, reference may also be made to European Patent 0 602 040 B1, corresponding to German Published, Non-Prosecuted Patent Application DE 41 29 518 A1 and corresponding U.S. Pat. No. 5,490,386.

In accordance with a concomitant mode of the invention, the hollow guide blade is preferably disposed in one of the last three guide-blade rows.

Furthermore, a reduction in the condensation of action steam on a guide blade of a steam turbine in the power mode is possible if, in this case, a hot fluid, in particular hot steam, is fed to the cavity of the guide blade. The hot fluid flows out through orifice conduits on the outer surface of the guide blade and is mixed with the action steam there and, if appropriate, on the entire outer surface of the guide blade. On one hand, the hot fluid causes the guide blade to be heated and, on the other hand, mixing with the action steam leads to heating of the action steam. Both effects contribute to a marked reduction, if not even to a complete avoidance, of the formation of condensate droplets on the guide blade. The risk of drop impact erosion on moving blades disposed downstream of the guide blade is thereby virtually eliminated.

Other features which are considered as characteristic for the invention are set forth in the appended claims.

Although the invention is illustrated and described herein as embodied in a thermal power plant having a steam turbine and a method for cooling a steam turbine in a ventilation mode, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
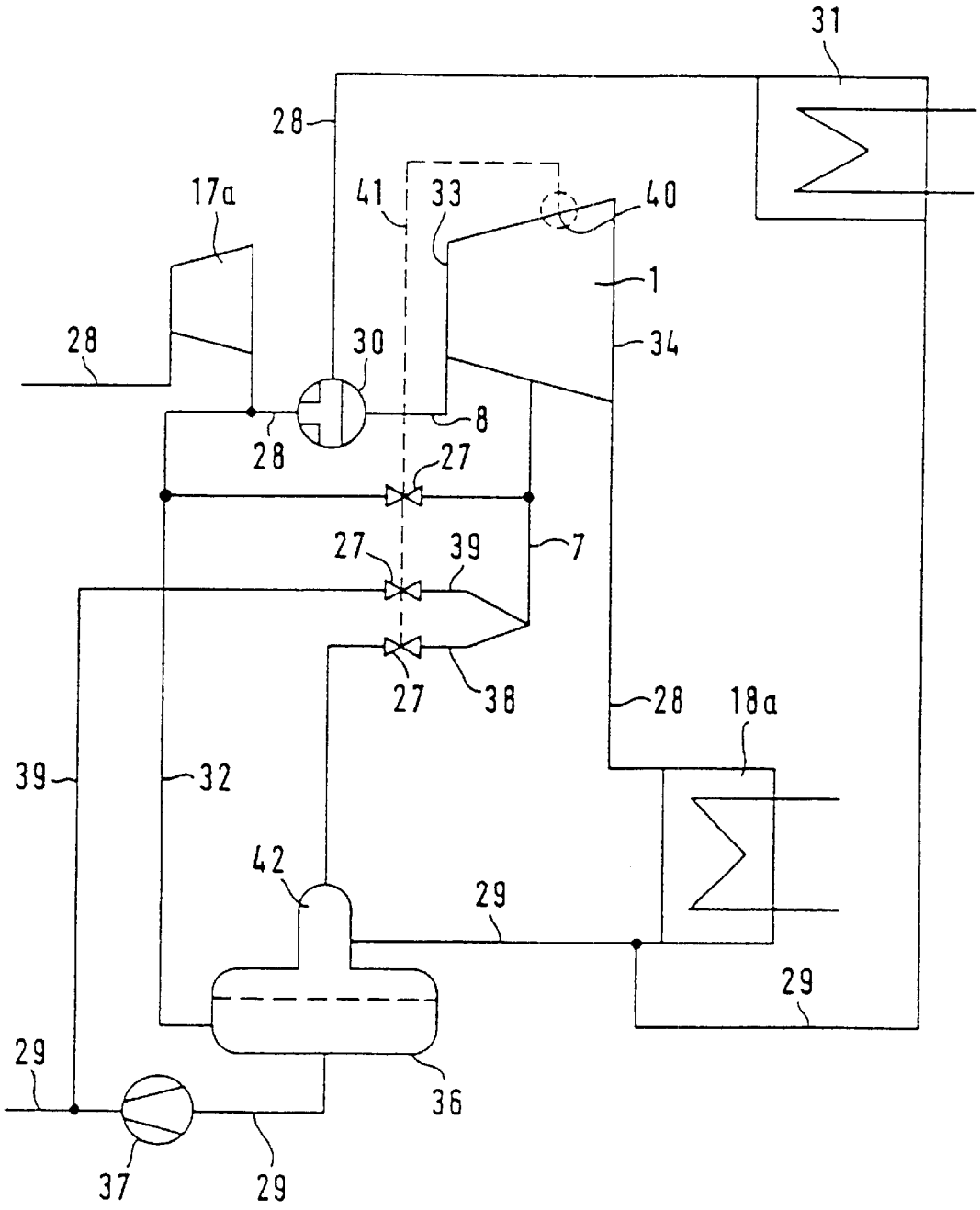
FIG. 1 is a schematic circuit diagram of a power station system with a low-pressure steam turbine.

Referring now to the figures of the drawings in detail and first, particularly, to FIG. 1 thereof, there is seen a diagrammatic illustration of a thermal power plant with a high-pressure steam turbine 17*a*, a low-pressure steam turbine 1, a condenser 18*a* and a condensate container 36, in which further components of the thermal power plant, for example a boiler or a generator, are not illustrated. The components of the thermal power plant which are illustrated are connected to one another through the use of steam connecting conduits 28 or condensate conduits 29. A condensate pump 37 is inserted into the condensate conduit 29. A change-over device 30 is located between the high-pressure steam turbine 17*a* and the low-pressure steam turbine 1, in the steam connecting conduit 28. Hot steam flowing off from the high-pressure steam turbine 17*a* can be diverted through a further steam connecting conduit 28 to a heating heat exchanger 31 with the aid of the change-over device 30, which is conventionally formed by flaps. Thus, the low-pressure steam turbine 1 is not subjected to hot steam, depending on the setting of the change-over device 30. The steam conducted past the low-pressure steam turbine 1 is condensed in the heating heat exchanger 31 and flows as condensate to the condensate container 36.

The low-pressure steam turbine 1 is rigidly coupled to the high-pressure steam turbine 17*a*, so that non-illustrated rotors of the two steam turbines 1 and 17*a* run synchronously. If the steam flowing off from the high-pressure steam turbine 17*a* is conducted past the low-pressure steam turbine 1, that is to say the latter rotates idly, friction occurs in the low-pressure steam turbine 1 due to the static pressure which prevails therein and which corresponds to the pressure of the steam in the condensate container 36. A fluid conduit 7 for introducing fluid into the low-pressure steam turbine 1 is disposed between an inlet 33, which serves for subjecting the turbine to action steam, and an outlet 34, through which the steam expanded in the low-pressure steam turbine 1 is conducted to the condenser 36. The fluid conduit 7 is connected to a cavity 6 of a guide blade 5*a* seen in FIGS. 2, 3 and 4. The condensate is heated in the condensate container 36 through the use of steam which is fed from the high-pressure steam turbine 17*a* through the use of a hot-steam conduit 32.

A steam-filled steam space 42 is located in the condensate container 36 above a condensate level. Steam is extracted from this steam space 42 and is fed to the fluid conduit 7 through a steam transfer conduit 38. Furthermore, condensate is fed from the condensate container 36 to the fluid conduit 7 through a condensate transfer conduit 39. A branch-off of the hot-steam conduit 32 is connected to the fluid conduit 7 through a corresponding valve 27. The steam transfer conduit 38 and the condensate transfer conduit 39 likewise each have a valve 27 and are connected to the fluid conduit 7. All of the valves 27 are connected to a temperature measuring point 40 in the low-pressure team turbine 1 through a control line 41. As a result, the quantity of fed-in condensate and steam from the steam space 42 and of hot steam from the high-pressure steam turbine 17*a* can be fed in a regulated manner into the fluid conduit 7 and, through the guide blade 5*a*, into the low-pressure steam turbine 1. Regulated cooling of the low-pressure steam turbine 1 in the ventilation mode, without work output being expended, and a feed of hot steam into the guide blade 5*a* to reduce the condensation of action steam, can thus be carried out.

Insofar as there is no condensate container 36 available for the extraction of steam or condensate, steam may be extracted, for example, from the heating heat exchanger 31 or from a non-illustrated preheater which is assigned to the high-pressure steam turbine 17*a*.

Figure 2:
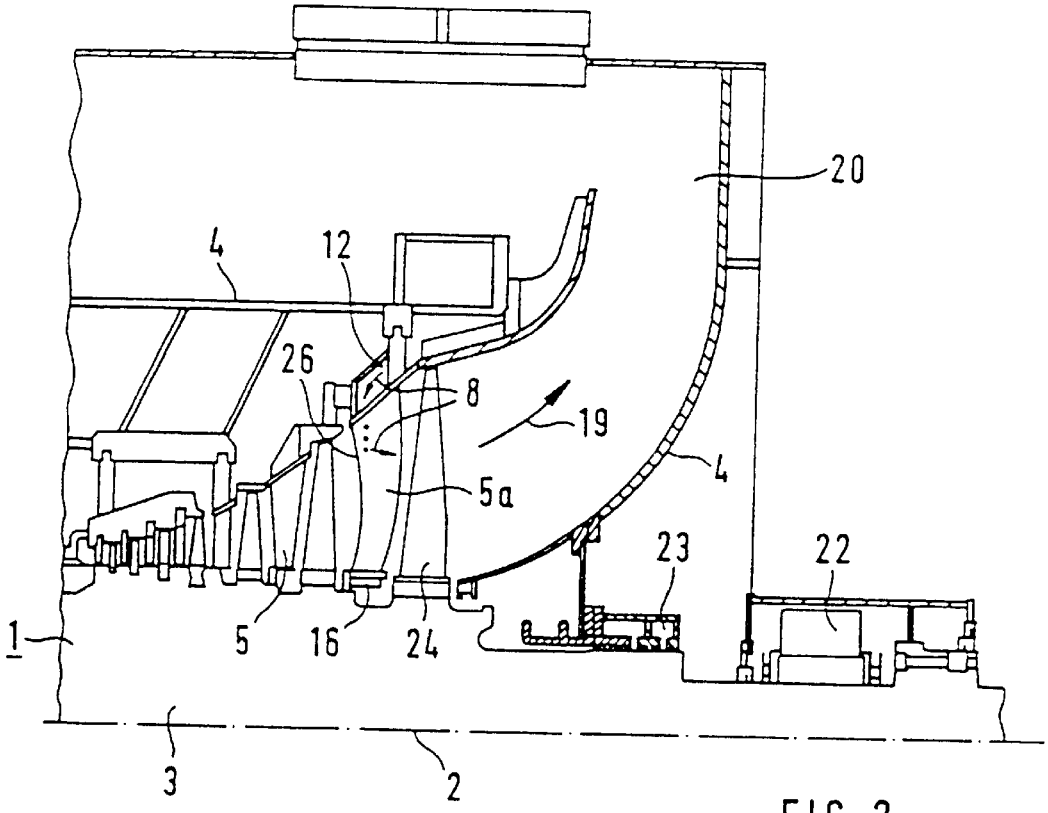
FIG. 2 is an enlarged, fragmentary, longitudinal-sectional view of a low-pressure steam turbine.

FIG. 2 shows a portion of a double-flow low-pressure steam turbine 1 with a turbine rotor 3 which is directed along a main axis 2 and which carries moving blades 24. The turbine rotor 3 is mounted in a turbine bearing 22 and is sealed off relative to an inner housing 4 of the steam turbine 1 through the use of a rotor gasket 23. Guide blades 5, which are connected to the inner housing 4, and the moving blades 24 of the rotor 3, are disposed alternately in the axial direction. The guide blades 5, in particular the guide blade 5*a* of the last low-pressure guide-blade row (guide-blade structure 11 seen in FIG. 3) are constructed, for example, as hollow guide blades inclined in the axial direction and curved in the circumferential direction. The guide blades 5, 5*a* of a guide-blade row are welded to a likewise hollow outer ring having an outer-ring chamber 12 of the inner housing 4 and are welded to an inner ring having an inner-ring chamber 16 adjacent the rotor 3 and surrounding the latter and are thus connected to one another. Action steam 19 flows through the low-pressure steam turbine 1 in the axial direction and is directed vertically and conducted out of the steam turbine 1 through an exhaust-steam port 20. The guide blade 5*a* has orifice conduits 9*a*, 9*b* seen in FIGS. 4 and 5, through which fluid 8 can be fed into the region of flow of the action steam 19.

The orifice conduits 9*b* are disposed in the vicinity of an onflow edge 26, on the suction side, preferably essentially facing the outer-ring chamber 12. The orifice conduits 9*a* are disposed on a delivery side.

Figure 3:
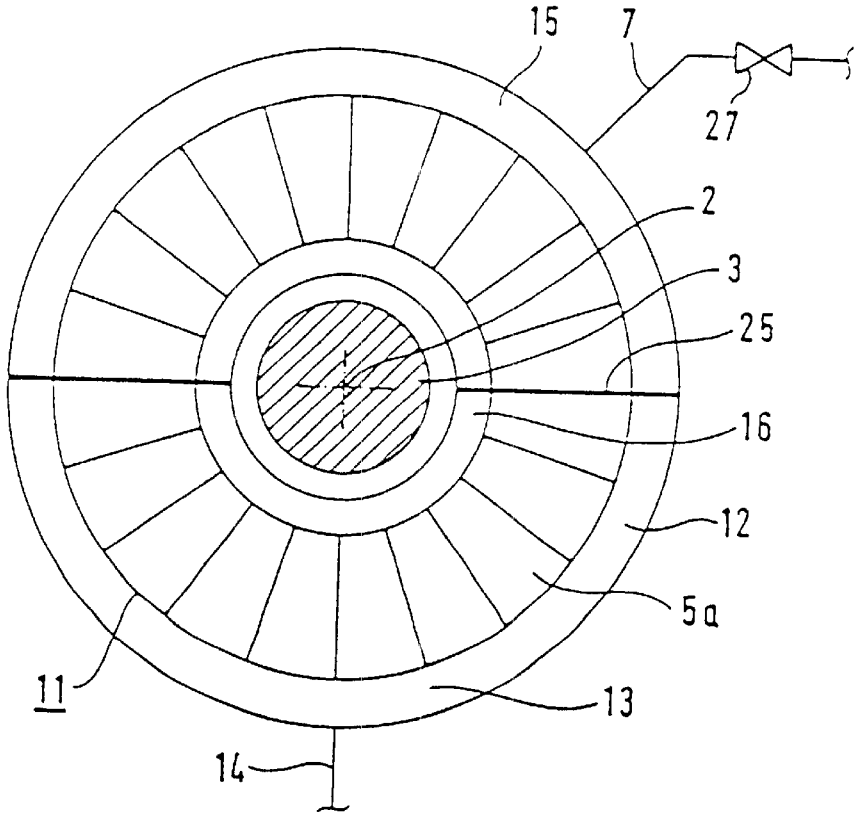
FIG. 3 is a further enlarged, cross-sectional view of the last guide-blade row of a low-pressure steam turbine.

FIG. 3 shows a cross-section through the guide-blade structure 11 of the last guide-blade row of the steam turbine 1. The fluid conduit 7, which can be shut off through the use of a valve 27, opens out into a geodetically high region or outer-ring chamber 15 of the outer-ring chamber 12. The guide blades 5*a*, which are welded to the outer-ring chamber 15, extend radially in the direction of the main axis 2 of the turbine rotor 3. They are welded to the inner-ring chamber 16 surrounding the turbine rotor 3. The guide-blade structure 11 is produced from two exactly fitting halves which are joined to one another along a parting plane 25. A drainage conduit 14 is provided in a geodetically lowest region 13 of the outer-ring chamber 12.

Figure 5:
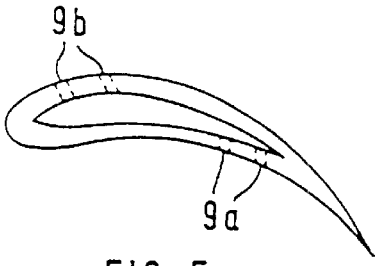
FIG. 5 is a cross-sectional view of a guide blade according to FIG. 4.
Figure 4:
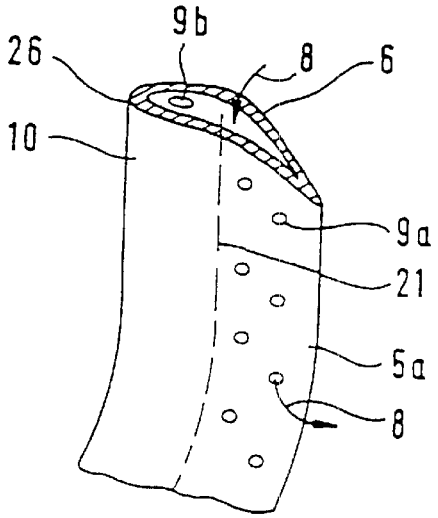
FIG. 4 is an even further enlarged, fragmentary, perspective view of a guide blade.

In the ventilation mode, condensate and/or wet steam can be introduced into the outer-ring chamber 12 through the fluid conduit 7. This steam 8 passes through the cavity 6 seen in FIGS. 4 and 5 into the guide blade 5*a*. The cavity 6 preferably extends from the outer-ring chamber 12 through the entire guide blade 5*a* along a center line 21 as far as the inner-ring chamber 16. The orifice conduits 9*b* and 9*a*, in particular bores, are provided on the suction side and the delivery side as is seen in FIGS. 4 and 5, and connect the cavity 6 to an outer surface 10 of the guide blade 5*a*. The fluid 8, the wet steam and/or the condensate, flows out of the guide blade 5*a* from these orifice conduits 9*a*, 9*b*. When the steam turbine 1 is in the ventilation mode, the outflowing fluid 8 causes the guide blade 5*a* to be cooled, in particular with a cooling film forming over its outer surface 10. When the steam turbine 1 is in the power mode, hot steam is fed to the cavity 6 through the fluid conduit 7, the hot steam is mixed with the action steam 19 on the outer surface 10 and, particularly when this is saturated steam, leads to a marked increase in temperature of the action steam 19. Moreover, the fed hot steam causes the guide blade 5*a* to be heated, so that the formation of condensate droplets, particularly on the flow-off edge of the guide blade 5*a*, is markedly reduced, if not even completely avoided.

The invention is distinguished by the fact that guide blades, in particular one or more of the last three guide-blade rows of a low-pressure steam turbine, have a cavity, from which orifice conduits lead onto the surface of the respective guide blade. In the ventilation mode, cooling fluid, in particular wet steam or condensate, and, in a power mode, hot steam, can be fed to this cavity through a fluid conduit. In the ventilation mode, this effectively achieves cooling of the guide blade by simple measures and, in the power mode, heating of the guide blade and heating of the action steam, with the formation of condensate on the guide blade, is avoided.

I claim:

1. A thermal power plant, comprising:

a steam turbine including:

a turbine rotor directed along a main axis;

an inner housing surrounding said turbine rotor;

a guide-blade structure disposed in said inner housing and surrounding said turbine rotor in circumferential direction, said guide-blade structure having guide blades; and at least one of said guide blades having a cavity formed therein, having an outer surface and having at least one orifice conduit branching off from said cavity and opening to said outer surface;

a fluid conduit connected to said cavity for feeding cooling fluid;

a condensate vessel; and a closeable transfer conduit connected between said condensate vessel and said fluid conduit.

2. The thermal power plant according to claim 1, including an outer-ring chamber of said steam turbine, said guide blades connected to said outer-ring chamber, and said fluid conduit opening into said outer-ring chamber.

3. The thermal power plant according to claim 2, wherein said outer-ring chamber has a geodetically lowest region, and a drainage conduit branches off from said geodetically lowest region.

4. The thermal power plant according to claim 2, wherein said outer-ring chamber has a geodetically high region, and said fluid conduit opens into said geodetically high region.

5. The thermal power plant according to claim 3, wherein said outer-ring chamber has a geodetically high region, and said fluid conduit opens into said geodetically high region.

6. The thermal power plant according to claim 2, including an inner-ring chamber, said guide blades connected to said inner-ring chamber.

7. The thermal power plant according to claim 3, including an inner-ring chamber, said guide blades connected to said inner-ring chamber.

8. The thermal power plant according to claim 4, including an inner-ring chamber, said guide blades connected to said inner-ring chamber.

9. The thermal power plant according to claim 5, including an inner-ring chamber, said guide blades connected to said inner-ring chamber.

10. The thermal power plant according to claim 1, wherein said guide blades of said guide-blade structure are bent.

11. The thermal power plant according to claim 1, wherein said guide blades of said guide-blade structure are inclined in axial direction and curved in circumferential direction.

12. The thermal power plant according to claim 1, including a first plant component carrying hot steam and a second plant component carrying water, condensate, or wet steam, said steam turbine connected to at least one of said first plant component in a power mode and said second plant component in a ventilation mode.

13. The thermal power plant according to claim 1, wherein said cavity extends entirely through said guide blade along a center line directed from said inner housing to said turbine rotor.

14. The thermal power plant according to claim 1, wherein said guide blade has a suction side and an onflow edge, and at least one of said orifice conduits opens on said suction side in the vicinity of said onflow edge.

15. The thermal power plant according to claim 1, wherein at least one of said orifice conduits is an approximately circular or elliptic hole in said outer surface of said guide blade.

16. A method for cooling a steam turbine in a ventilation mode, which comprises:

providing a turbine rotor directed along a main axis;

providing an inner housing surrounding the turbine rotor;

providing a guide-blade structure in the inner housing surrounding the turbine rotor in circumferential direction;

providing a hollow guide blade of the guide-blade structure, the hollow guide blade having an outer surface and a cavity;

providing orifice conduits connecting the cavity of the hollow blade guide to the outer surface of the hollow blade guide; and feeding wet steam through the hollow guide blade, the wet steam flowing through the orifice conduits to the outer surface of the guide blade.

17. The method according to claim 16, which comprises providing the guide-blade structure as one of a plurality of guide-blade structures, and carrying out the feeding step by feeding the wet steam to one of the guide-blade structures disposed last in flow direction.

18. A method for cooling a low-pressure steam turbine in a ventilation mode, which comprises:

providing a turbine rotor directed along a main axis;

providing an inner housing surrounding the turbine rotor;

providing a guide-blade structure in the inner housing surrounding the turbine rotor in circumferential direction;

providing a hollow guide blade of the guide-blade structure, the hollow guide blade having an outer surface and a cavity;

providing orifice conduits connecting the cavity of the hollow blade guide to the outer surface of the hollow blade guide; and feeding wet steam through the hollow guide blade, the wet steam flowing through the orifice conduits to the outer surface of the guide blade.

* * * * *